United States Patent [19]

LaBianca

[11] Patent Number: 4,920,720

[45] Date of Patent: May 1, 1990

[54] FLOORING COMPOSITE AND METHOD FOR MAKING SAME

[75] Inventor: Michael H. LaBianca, Northampton, Pa.

[73] Assignee: Tarkett Inc., Parsippany, N.J.

[21] Appl. No.: 217,288

[22] Filed: Jul. 11, 1988

[51] Int. Cl.[5] ..... E04B 1/38; E04B 2/00; B32B 23/02

[52] U.S. Cl. ..... 52/506; 52/746; 156/71; 428/194; 428/201; 428/351

[58] Field of Search ..... 428/40, 516, 518, 517, 428/355, 351, 343, 194, 201; 156/71; 52/746, 309.3, 506

[56] References Cited

U.S. PATENT DOCUMENTS

| | | | |
|---|---|---|---|
| 703,928 | 7/1902 | Hutchinson | 52/746 |
| 2,605,514 | 8/1952 | Eshnauer | 156/71 |
| 3,765,972 | 10/1973 | Wesp | 156/71 |
| 3,990,929 | 11/1976 | Evans | 156/71 |
| 4,114,346 | 9/1978 | Kelly | 428/40 |
| 4,159,219 | 7/1979 | Evans | 156/71 |
| 4,557,774 | 12/1985 | Hoopengardner | 428/343 |
| 4,702,948 | 10/1987 | Sieber-Gadient | 428/40 |
| 4,751,130 | 7/1988 | Grossmann | 156/71 |

*Primary Examiner*—George F. Lesmes
*Assistant Examiner*—J. Davis
*Attorney, Agent, or Firm*—Burns, Doane, Swecker & Mathis

[57] ABSTRACT

A method is provided for adhering a shrink sheet floor covering to subflooring using a double-faced adhesive tape applied along the perimeter of the subflooring, as well as a composition therefor. The adhesive tape includes a substrate having on each side an adhesive layer. One of the adhesive layers is bonded to the subflooring, and the other adhesive layer is bonded to the shrink sheet floor covering. The adhesive layer bonded to the floor covering is tolerant to plasticizer migrating from such covering. Migration of plasticizer to the adhesive layer bonded to the subflooring is prevented by means of the adhesive tape substrate layer, which is substantially impermeable to plasticizer migration. The adhesive tape is applied only along the perimeter of the subflooring, allowing the shrink flooring material to shrink freely at all points within the perimeter after application to the subflooring.

16 Claims, 1 Drawing Sheet

FLOORING COMPOSITE AND METHOD FOR MAKING SAME

BACKGROUND OF THE INVENTION

The present invention relates to a flooring composite which includes a shrink sheet floor covering layer (i.e., shrink flooring), and to a method for adhering the shrink flooring to a subflooring. Shrink flooring material has been used for a number of years in the construction of residential housing.

Shrink flooring has a number of advantages, including ease of installation, less subfloor preparation than other types of flooring materials, and high flexibility.

The mechanism by which shrink flooring works is well known and is a combination of the balance of the modulus of the top layer and the bottom layer of the flooring, and the stress-induced creep caused by rolling of the flooring prior to use. Before installing, the shrink flooring is rolled face out around a core, which is usually 4 inches in diameter or smaller. The top layer of the shrink flooring is thereby stretched. This stress causes creep, that is, molecular orientation to alleviate the applied stress. When the material is installed, the higher modulus of the top layer maintains the stretched length of the top layer and induces a stress in the bottom layer. The induced stress in the bottom layer then acts to reverse the creep in the top layer resulting in the product apparently shrinking. This shrinking occurs over a period of time after installation of the shrink flooring and gives the shrink flooring a number of advantages, including the ability to bridge smaller defects in the subflooring.

Heretofore, shrink flooring has been applied to subflooring by the use of staples or glue along the perimeter. The disadvantages of staples are that they cannot be used on a concrete floor, and that it may be difficult or impossible to staple under the toekicks of cabinets. The disadvantages of glue include the fact that it is messy, and that it has a limited working time, defined as the time during which the shrink flooring can be moved or adjusted in place after application of the glue. Other disadvantages of glue include increased waste, and finally, the solvents used in some glues are generally flammable.

There is thus a need in the art for a method of installing shrink flooring material which does not have the problems noted above inherent in the use of staples or glue. The present invention solves these problems through the use of a double-faced adhesive tape as described hereinafter.

The concept of opposing adhesive surfaces has been used in securing carpeting, as taught by U.S. Pat. No. 4,557,774. In this patent, a carpet pad positioned between a carpet and a floor surface has pressure-sensitive adhesive applied on its upper and lower surfaces.

SUMMARY OF THE INVENTION

It is accordingly an object of the present invention to provide a method for adhering shrink flooring to a variety of subflooring materials.

It is another object of the invention to provide a method for adhering shrink flooring to a subflooring, as above, wherein the use of staples and/or glue is eliminated.

These objects are achieved by a method for securing shrink flooring to a subflooring, comprising the steps of securing one side of a double-faced adhesive tape along the perimeter of a subflooring surface, and securing the shrink flooring material onto the other side of the double-faced adhesive tape to thereby adhere the shrink flooring to the subflooring, wherein the shrink flooring is shrinkable after securement to the subflooring.

The objects of the invention are also achieved by a composite which comprises a subflooring and a shrink flooring applied over the subflooring, the shrink flooring being attached to the subflooring by means of a double-faced adhesive tape positioned between the shrink flooring and the subflooring along the perimeter of the subflooring, a first side of the adhesive tape having a first adhesive composition and adhering to the subflooring, and a second side of the adhesive tape having a second adhesive composition and adhering to the shrink flooring.

BRIEF DESCRIPTION OF THE DRAWING

For a full understanding of the true scope of the invention, reference should be made to the following detailed description and the drawing, wherein.

DETAILED DESCRIPTION OF THE PREFERRED EMBODIMENTS

Figure 1:
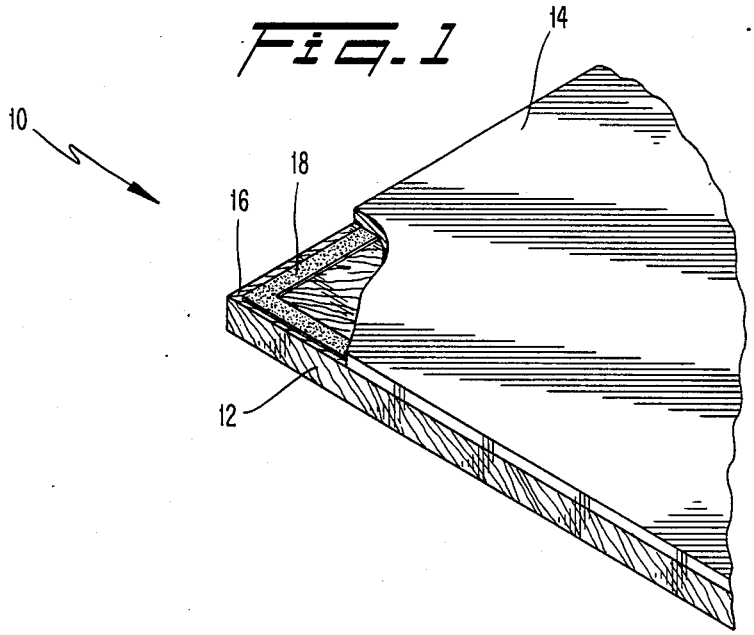
FIG. 1 is a cut-away view of one embodiment of a composite floor of the invention showing the various layers thereof.

As shown in FIG. 1, a flooring composite used, for example, in housing applications, is designated generally by the number 10. The flooring composite 10 includes a subflooring 12 which can be constructed of any of the well-known materials used in this application, including concrete, plywood, etc. A shrink flooring, i.e. shrink sheet floor covering 14, is adhered to an upper surface 16 of the subflooring 12 by means of a two-faced adhesive tape 18. The shrink sheet floor covering 14 can be any known type used in the art. A preferred material for the shrink flooring is polyvinyl chloride or "vinyl". Other suitable materials include the various polyurethanes. It is emphasized that the type of material used as the shrink sheet floor covering is not critical to the invention.

Figure 2:
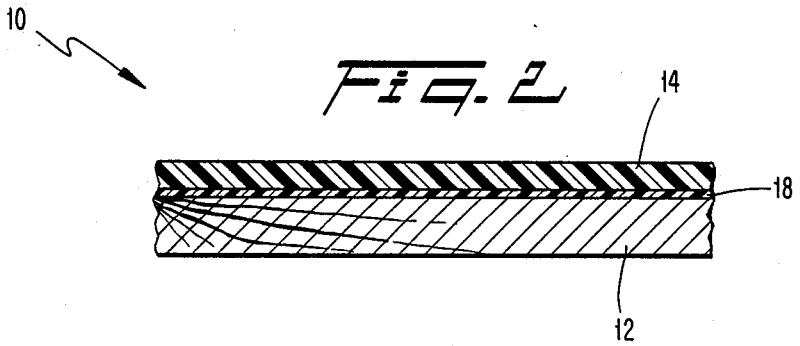
FIG. 2 is a cross-sectional view of the flooring composite.

FIG. 2 illustrates in cross-section the joining of the various components of the flooring composite 10, with the two-faced adhesive tape 18 joining the shrink sheet floor covering 14 to the subflooring 12.

Figure 3:
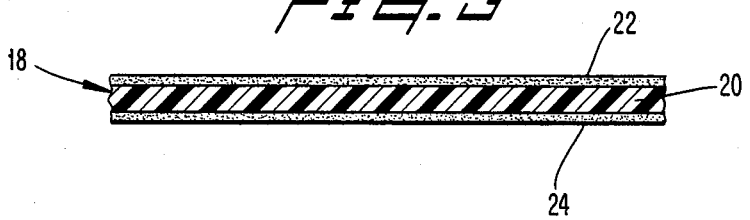
FIG. 3 is a cross-sectional view of one embodiment of the adhesive tape used in the invention.

FIG. 3 illustrates in cross-section the two-faced adhesive tape 18 utilized in the invention. A substrate 20, which is generally flexible, includes on opposing surfaces, separate adhesive layers. The upper adhesive layer 22 is adherable to the shrink sheet floor covering, while the lower adhesive layer 24 is applied to the subflooring 12.

The substrate commonly has a thickness of from about 0.00025 inch to about 0.005 inch, with from about 0.001 inch to about 0.002 inch being preferred. The adhesive layers commonly each have a thickness of from about 0.0005 inch to about 0.004 inch with from about 0.001 inch to about 0.0025 inch being preferred.

Because plastic materials such as vinyl contain a certain amount of plasticizer which can migrate out of the polymeric material, the adhesive layer 22 must be resistant to loss of adhesion due to contact with the plasticizer from the shrink flooring. A number of adhesives, including pressure sensitive adhesives, have the proper characteristics and can be used for the adhesive layer 22. Examples of suitable adhesives include acrylics in general, examples of which are polyacrylate, polymethacrylate, polymethylmethacrylate and the various acrylic copolymers which include one or more types of repeating units such as butylacrylate, ethylacrylate, 2-ethylhexylacrylate, vinylacrylate, etc. Adhesives which are specially formulated to be resistant to plasticizer migration are both well known and available from a variety of courses. One such source is FLEX Con Company, Spencer, Mass. under the designation V-106.

The adhesive layer 24 must provide good adhesion to a variety of different subflooring materials, such as concrete, wood, etc. Suitable adhesives include the types listed above for adhesive layer 22 but which are formulated to adhere aggressively to any of the various known subflooring materials. Such adhesives are also well known and readily available. One such material is manufactured by FLEX Con Company under the designation V-156. In addition to the various acrylic homo- and copolymers, there may be used various cements made from natural and synthetic rubbers such as polyisobutylene, polyisoprene, styrene-butadiene rubber (SBR), etc.

It has generally been found that adhesives useful in this regard lose adhesion when contacted with plasticizer. Thus, the migration of plasticizer from the floor covering 14, through the adhesive layer 22 and the substrate 20 into the adhesive layer 24 would cause loss of adhesion of the adhesive tape to the subflooring. To prevent this, the substrate 20 is preferably constructed of a material which provides a barrier to the migration of plasticizer. Suitable materials for the substrate 20 include various forms of polyethylene film, polypropylene, polyester, polyimide, acetate, etc. Generally such materials are crystalline polymers.

It is to be understood that the invention also contemplates the use of adhesives for layer 24 which are resistant to the effects of plasticizer yet maintain high adhesion to various subflooring materials, thus eliminating the need for barrier properties in substrate 20.

Commonly, the thickness of the adhesive tape substrate is from about 0.00025 inch to about 0.005 inch, with from about 0.001 inch to about 0.002 inch being preferred. The thickness of each of the adhesive layers 22, 24 commonly is from about 0.0005 inch to about 0.004 inch with from about 0.001 inch to about 0.0025 inch being preferred. The width of the adhesive tape commonly is from about 1 inch to about 6 inches with from about 2 inches to about 3 inches being preferred.

The following example is presented as a specific illustration of the claimed invention. It should be understood, however, that the invention is not limited to the specific details set forth in the example.

EXAMPLE

A. Preparation of two-faced adhesive tape

A silicone release coating is applied to both sides of 80 lb/3,000 $ft^2$ Kraft release base paper. On one side of the paper, the coating has a significantly higher release level than on the other side of the paper, that is, the coating on the higher release level requires more force to effect release. Over the higher release level coating is sequentially applied the following:

1. 0.0015 inch thick layer of a plasticizer-resistant adhesive having an acrylic base and obtainable from FLEX Con Company under the designation V-106.

2. 0.001 inch thick polyester film which provides a barrier to plasticizer migration.

3. 0.002 inch thick layer of a subfloor adhesive having an acrylic base and obtainable from FLEX Con Company under the designation V-156.

The resulting two-faced adhesive tape is wound on itself such that the release base paper keeps the two adhesive sides from bonding to each other. The lower release level side of the release base paper ensures that the release base paper is maintained on the plasticizer-resistant adhesive layer. The adhesive tape is slit into 3 inch wide rolls of appropriate length for floor covering installations.

B. Shrink floor installation

The subflooring, consisting of plywood, is cleaned to remove all dust and grime. A commercially available shrink flooring consisting of polyvinyl chloride sheet material is cut and fitted over the subflooring. The perimeter of the shrink flooring is rolled back and the adhesive tape prepared in Part A is unwound and applied to the subflooring perimeter with the subfloor adhesive layer in contact with the subflooring. The release base paper is then removed and the shrink flooring rolled back over the adhesive tape, thereby contacting the exposed plasticizer-resistant adhesive layer. The perimeter is then pressed to insure a good bond. Over time, the shrink floor contracts, and thereby wrinkles are removed from the shrink flooring while simultaneously the perimeter is held secure by the adhesive tape.

Although the invention has been described with preferred embodiments, it is to be understood that variations and modifications may be employed without departing from the concept of the invention as defined in the following claims.

What is claimed is:

1. A method for the permanent installation of a shrink sheet floor covering to a subflooring, comprising the steps of:

securing one side of a double-faced adhesive tape along the perimeter of a subflooring surface; and securing the shrink sheet floor covering onto the other side of said double-faced adhesive tape to thereby adhere said shrink sheet floor covering to said subflooring and thereby form the permanent installation;

wherein said shrink sheet floor covering is shrinkable after being adhered to said subflooring; and wherein said double-faced adhesive tape includes a substrate layer which is substantially impermeable to plasticizer.

2. A method as claimed in claim 1, wherein said shrink sheet floor covering is polyvinyl chloride or polyurethane.

3. A method as claimed in claim 1, wherein said double-faced adhesive tape comprises first and second adhesive layers applied over respective opposing sides of said substrate layer.

4. A method as claimed in claim 3, wherein said second adhesive layer is applied over said subflooring and said first adhesive layer is applied to said shrink sheet floor covering, said first adhesive layer being resistant to loss of adhesion due to migration of plasticizer from said shrink sheet floor covering.

5. A method as claimed in claim 4, wherein said first adhesive layer is an acrylic adhesive.

6. A method as claimed in claim 4, wherein said second adhesive layer is selected from the group consisting of an acrylic adhesive, natural rubbers, and synthetic rubbers.

7. A method as claimed in claim 4 wherein said first and second adhesive layers are acrylic adhesives.

8. A method as claimed in claim 4, wherein said first adhesive layer comprises a pressure sensitive adhesive selected from homo- and copolymers of acrylic acid, methacrylate and methylmethacrylate, and wherein said second adhesive layer comprises a pressure sensitive adhesive selected from natural and synthetic rubbers, homo- and copolymers of acrylic acid, methacrylate and methylmethacrylate and wherein said copolymers include repeating units selected from the group consisting of butylacrylate, ethylacrylate, 2-ethylhexylacrylate and vinylacrylate.

9. A flooring composite, comprising:

a subflooring; and a shrink sheet floor covering, applied over said subflooring, said shrink sheet floor covering being attached to said subflooring by means of a double-faced adhesive tape positioned between said shrink sheet floor covering and said subflooring along the perimeter of a surface of said subflooring;

wherein the double-faced adhesive tape includes a substrate layer which is substantially impermeable to plasticizer.

10. A flooring composite as claimed in claim 9, wherein said shrink sheet floor covering is polyvinyl chloride or polyurethane.

11. A flooring composite as claimed in claim 9, wherein said double faced adhesive tape comprises first and second adhesive layers applied over respective opposing sides of said substrate layer.

12. A flooring composite as claimed in claim 9, wherein said second adhesive layer is applied to said subflooring and said first adhesive layer is applied to said shrink sheet floor covering, said first adhesive layer being resistant to loss of adhesion due to migration of plasticizer from said shrink sheet floor covering.

13. A flooring composite as claimed in claim 12, wherein said first adhesive layer is an acrylic adhesive.

14. A flooring composite as claimed in claim 12, wherein said second adhesive layer is selected from the group consisting of an acrylic adhesive, natural rubbers and synthetic rubbers.

15. A flooring composite as claimed in claim 12, wherein said first and second adhesive layers are acrylic adhesives.

16. A flooring composite as claimed in claim 9, wherein said first adhesive layer is selected from the group consisting of homo- and copolymer of acrylic acid, methacrylate and methylmethacrylate and wherein said second adhesive layer is selected from natural and synthetic rubbers and homo- and copolymers of acrylic acid, methacrylate and methylmethacrylate and wherein said copolymers include repeating units selected from the group consisting of butylacrylate, ethylacrylate, 2-ethylhexylacrylate and vinylacrylate.

* * * * *